US005164710A

United States Patent [19]

Anderegg et al.

[11] Patent Number: 5,164,710

[45] Date of Patent: Nov. 17, 1992

[54] METHOD OF OBTAINING A THREAD RUNNING SIGNAL

[75] Inventors: Peter Anderegg; Peter Oehy, both of Winterthur, Switzerland

[73] Assignee: Maschinenfabrik Rieter AG, Winterthur, Switzerland

[21] Appl. No.: 867,294

[22] Filed: Apr. 10, 1992

Related U.S. Application Data

[63] Continuation of Ser. No. 633,229, Dec. 21, 1990, abandoned.

[30] Foreign Application Priority Data

Dec. 22, 1989 [DE] Fed. Rep. of Germany ..... 3942685

[51] Int. Cl.[5] ..... G08B 21/00

[52] U.S. Cl. ..... 340/677; 310/323; 340/668

[58] Field of Search ..... 340/677, 668, 825.71; 310/323; 200/61.14, 61.18; 112/278

[56] References Cited

U.S. PATENT DOCUMENTS

| | | | |
|---|---|---|---|
| 3,844,101 | 10/1974 | Schwartz | 200/61.18 X |
| 4,110,654 | 8/1978 | Paul | 310/323 |
| 4,361,777 | 11/1982 | Mettler | 310/323 X |

*Primary Examiner*—Jin F. Ng
*Assistant Examiner*—Thomas J. Mullen, Jr.
*Attorney, Agent, or Firm*—Dority & Manning

[57] ABSTRACT

In a method of obtaining a thread tension signal a sensor in the form of a piezofoil is attached to a thread guide or to its mounting and delivers a signal which reflects, amongst other things, the oscillations induced in the thread guide by the thread movement. In order to obtain a signal which corresponds to the thread tension either the frequency of an element which winds up the thread and/or harmonics of this frequency is filtered out of the sensor signal and the level of this frequency or the level of these frequencies is measured.

19 Claims, 8 Drawing Sheets

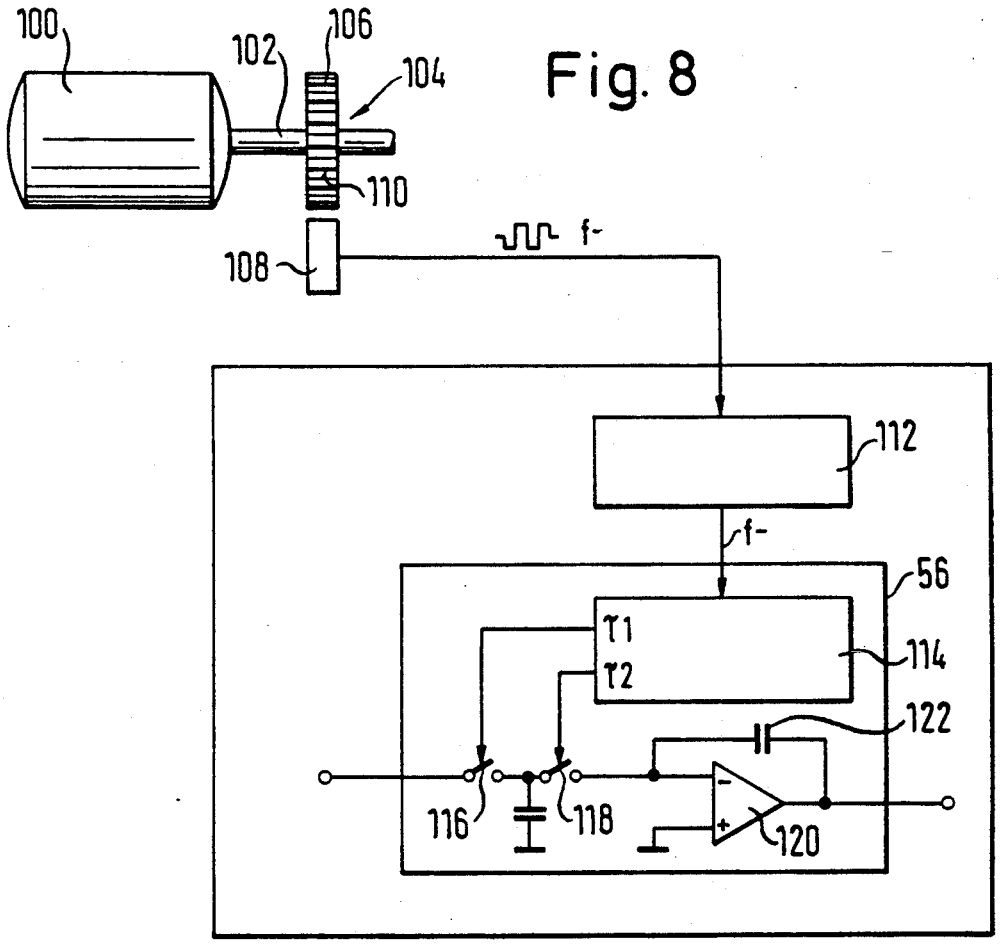
Fig. 8
Fig. 9
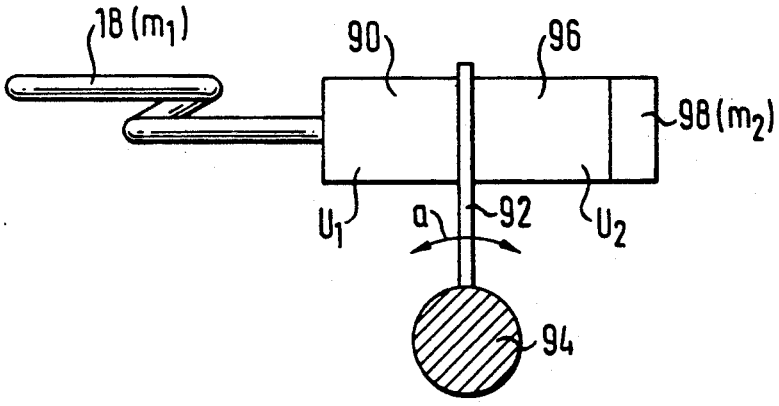

METHOD OF OBTAINING A THREAD RUNNING SIGNAL

This is a continuation of application Ser. No. 07/633,229, filed Dec. 21, 1990, now abandoned.

BACKGROUND OF THE INVENTION

The present invention relates to a method of obtaining a thread running signal in which at least one sensor is attached to the mounting of a thread guide and delivers a signal which, among other things, reflects the oscillations induced in the thread guide by the thread movement.

A method and a thread sensor of this kind are already known from German patent publication DE-OS 29 19 836.

It is the aim in the textile machine industry to be able to monitor the production at each spindle of a spinning machine. A thread break at a spinning position results in a loss of production and paid work and can, in certain cases, also lead to damage to the machine. The main causes of thread breaks are for example thin locations in the yarn, poorly serviced parts in the yarn forming process or incorrect adjustment of the spinning machine.

Known thread monitoring devices detect among other things parameters such as the ballooning of the thread or the speed of rotation of the ring traveller in the ring spinning machine, the temporal changes of the thickness of the running thread or the cross-section of the thread. As a result of the high manufacturing costs such devices are, however, only used in a few machines. The initially named DE-OS 29 19 836 discloses a thread breakage sensor which consists of a piezoelectric element mounted on a part of the thread guide with its output signal being further processed to determine whether a thread break is present.

Through the contact of the thread guide with the spun thread high frequency oscillations of the thread guide arise which are mixed with mechanical oscillations of the ring spinning machine.

As can be seen in DE-OS 29 19 836 the frequency of the mechanical oscillations amounts to about 1 kHz while the thread guide oscillates at about 15 kHz. These latter oscillations are evaluated in DE-OS 29 19 836 to determine whether thread breaks are present in such a way that one discriminates the natural oscillations relative to the mechanical oscillations. Stating more precisely the two connection lines of the piezoelectric element are connected to a bandpass filter which picks up the natural oscillation components in the output signals of the piezoelectric element, i.e. transmits them. These natural oscillation components are then amplified by means of an amplifier to a specific value. A rectifier converts the AC voltage signals into DC voltage signals. A voltage range in which normal operation is guaranteed is determined with the aid of a voltage comparator and a corresponding logic output signal is then present at the output of the comparator (DE-OS 29 19 836, page 10, line 29 to page 11, line 6).

The thread sensor of DE-OS 29 19 836 is however only able to determine thread breaks but is not, however, able to measure thread tension.

SUMMARY OF THE INVENTION

The present invention is based on the object of providing a thread tension measurement apparatus at favorable cost which can, if necessary, also serve as a thread breakage detector, which is inexpensive to manufacture and which can be attached to existing machines which process or generate the thread without the attachment itself leading to a change of the thread tension or to an undesired additional loading of the thread.

Starting from the known method or sensor the present invention is characterized method-wise in that a sensor with a relatively broad band frequency response is used in the form of a piezofoil which is at least substantially arranged in a plane containing the thread running direction, or in a plane parallel to this, so that the mounting for the thread guide executes elastic movements to both sides; in that in order to obtain a signal corresponding to the thread tension either the frequency of an element which winds up the thread and/or harmonics of this frequency are filtered out of the sensor signal and the level of this filtered out frequency or frequencies is measured, with the filtered out frequency or frequencies lying substantially above the basic oscillation frequency of the thread guide, i.e. the natural oscillation frequency of the thread guide; and in that the transmission frequency of the filter is adjusted in accordance with the change in frequency of the element which winds up the thread, with the quality factor (Q) of the filter preferably being kept at least substantially constant.

The invention relates to the recognition that the output signal of the sensor is a complex analog signal which contains, among other things, the speed of rotation of the ring traveller as a basic oscillation in the time-dependent plot of the deflection of the thread guide and also harmonic values of this basic oscillation together with the so-called thread noise, and indeed in addition to other oscillations such as self-oscillation of the thread guide and oscillations induced by machine vibrations. Furthermore, the invention relates to the inventive recognition that both the level (amplitude) of the sensor signal at the frequency corresponding to the speed of rotation of the ring traveller and also the level of harmonic frequencies of the speed of rotation of the ring traveller are a function of the thread tension so that an evaluation of the thread tension is possible either at the basic frequency (f1) or at the harmonic frequencies (f2 to f9) of the speed for rotation of the ring traveller.

The evaluation of the sensor signal can be effected in such a way that the magnitude of the thread tension is determined as a value or in such a way that a comparison is made with a reference signal. This reference signal can depend on machine parameters such as the speed of rotation of the spindle, the state of servicing etc. The result of this comparison can be used to control the corresponding machine, for example to control the speed of rotation of a ring spinning machine in the sense of maintaining a predetermined thread tension or a predetermined plot of the thread tension throughout the process of cop formation.

It should be pointed out here that the amplitude of the natural oscillation of the thread guide which is evaluated in DE-OS 29 19 836 to obtain a thread breakage signal is practically independent of the thread tension and thus offers no possibility of evaluating the thread tension.

Various advantages are present with the method and apparatus of the invention:

a) The method or the apparatus permits the quantitative determination of the thread tension over a wide range of frequencies or speeds of rotation since the weak natural frequency or resonant frequency of the thread guide with its mounting or suspension lies beneath the range of frequencies which are useful for the thread tension sensor.

b) The thread sensor replaces an existing element at the spinning machine, namely the thread guide, so that the use of the thread tension sensor does not represent any additional loading for the thread.

c) The thread sensor can be manufactured at a favorable cost and operated either only as a thread breakage sensor or also as a thread tension sensor.

d) In accordance with the invention a portable thread tension measuring apparatus can also be provided which is in particular with a thread guiding eye in the form of a pig tail which can be placed around a running thread without interrupting the run of the thread.

Particularly preferred variants of the method of the method of the invention or of the apparatus of the invention, above all with respect to the signal evaluation will be found in the detailed-description. The design of the tuned filter as a filter in a switched capacitor embodiment is particularly favorable cost-wise and particularly effective.

When using the thread sensor of the invention on a ring spinning machine the thread guide is preferably formed as the thread guiding eye, for example in the form of the known pig tail. The thread guiding eye can be secured to its holder by means of mounting in the form of a leaf spring, with the sensor then being secured to the leaf spring. The leaf spring should be arranged with its plane essentially parallel to the thread movement. It is, however, also possible to form a part of the thread guide or of the thread eye itself as a spring in place of a leaf spring, with the sensor or sensors then being attached to this spring part.

The piezosensors which are used in the prior art are piezocrystals which have a pronounced resonant frequency and as a result have an insufficiently broad-banded frequency response for the purposes of the invention.

A particular embodiment of the present invention is characterized in that the piezofoil is a so-called PVDF foil which can be obtained at extremely favorable cost and which is made extremely thin. These piezofoils have a very broad-banded frequency response and the use of such piezofoil advantageously does not lead to falsification of the measured oscillations.

It is also possible, in accordance with the invention, to provide for one or more of the thread tension sensors a non-thread guiding reference sensor which transmits a signal dependent on the machine vibrations, with it being possible to compare the thread tension signals with the reference signal and to form a difference value. The reference signal can, however, also be used for the generation of a binary thread breakage indication signal (thread broken/thread not broken). It is, however, also possible, by means of the reference sensor, to recognize loud environmental noises such as ultrasonic noises from pressurized air etc. and to declare thread tension information generated in the same time period as invalid.

DESCRIPTION OF THE DRAWINGS

The invention will subsequently be explained in more detail with reference to embodiments and to the drawing in which are shown:

FIG. 8 is a block circuit diagram of a tuned filter in a switched capacitor embodiment.

FIG. 9 is a schematic illustration of a special embodiment of the invention.

DESCRIPTION OF THE PREFERRED EMBODIMENTS

Figure 2:
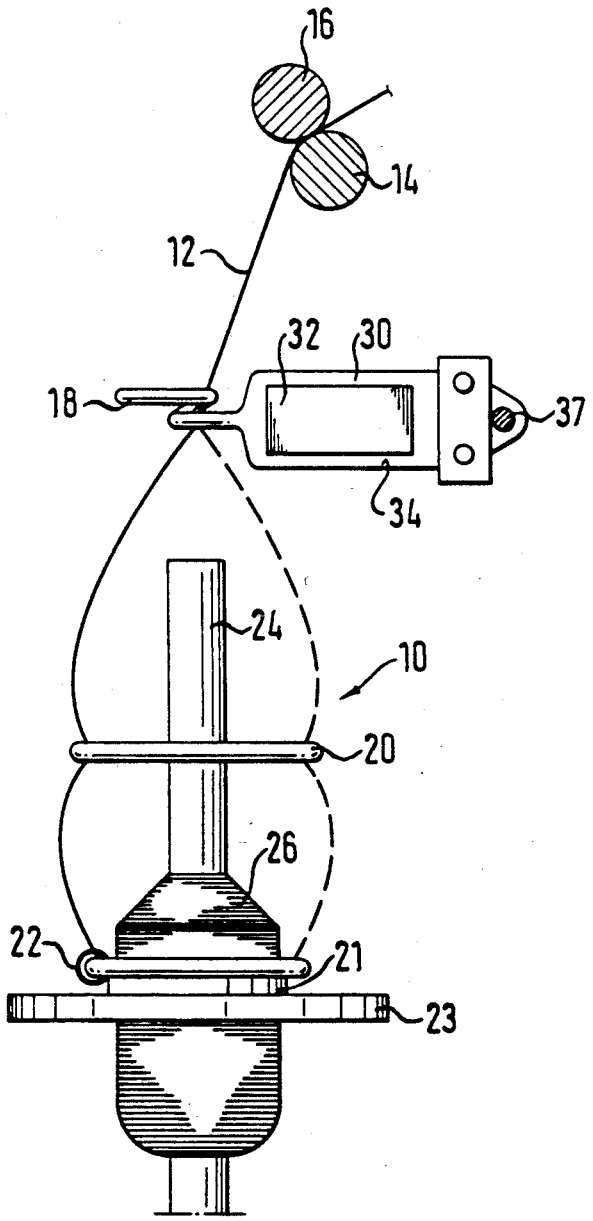
FIG. 2 is a schematic illustration of a spinning position of a ring spinning machine with the thread guiding eye of FIGS. 1*a* and 1*b*.

In order to facilitate the subsequent explanations reference is first made to FIG. 2. FIG. 2 shows a sideview of a spinning station 10 of a ring spinning machine in which a thread 12 leaves the delivery cylinders or outlet rollers 14, 16 of the drafting mechanism and leads through the thread guiding eye 18 and an anti-balloon ring 20 to a ring traveller 22 which is rotating around a ring track of the ring rail 23, whereby the thread is wound onto the rotating spindle sleeve 24 to form a cop 26. The thread is led around the spindle sleeve by the rotation of the ring traveller in such a way that a thread balloon forms as a result of the centrifugal force, with the thread balloon being restricted by the anti-ballooning or balloon restriction ring 20 and having its tip in the thread guiding eye. The friction and air resistance of the ring traveller, the air resistance of the thread and the frictional resistance between the thread and the ring traveller and between the thread and the balloon restriction ring produce a thread tension which can be measured at the location of the thread guide.

This thread tension increases with increasing speed of rotation of the spindle. Of interest is in particular a speed of rotation of the spindles between about 6000 rpm and 20,000 rpm, with the thread tension sensor as described here being straightforwardly suited to speeds of spindle rotation or rotation of the ring traveller (which only lie about 1 or 2% lower than the speeds of rotation of the spindle and which can thus be equated with the latter) up to 30,000 rpm and higher.

The contact of the tensioned thread in the thread guiding eye leads to frictional forces which act both in the horizontal direction and also in the vertical direction.

Figure 1A:
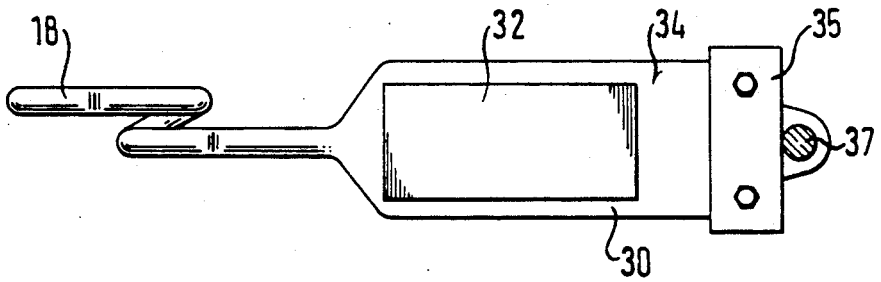
FIG. 1*a* is a sideview of a thread guiding eye of a ring spinning machine, with this eye being equipped with a thread sensor in accordance with the invention.
Figure 1B:
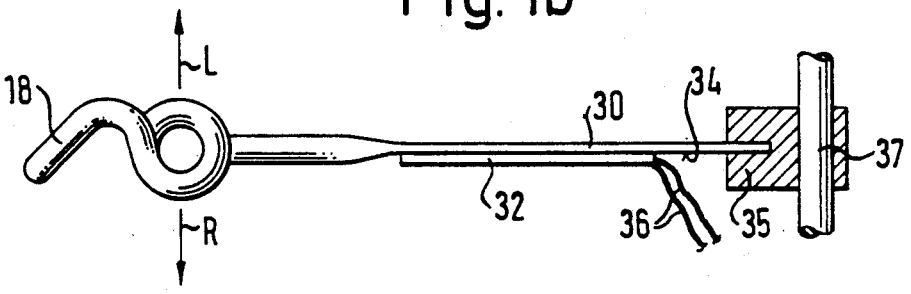
FIG. 1*b* is a plan view of the embodiment of FIG. 1*a*.

In the illustrated embodiment of the thread sensor of the invention the horizontal components of this friction force are exploited which, as a result of the frictional coefficient are proportional to the thread tension. This thread sensor is schematically illustrated in FIGS. 1*a* and 1*b*. Here the thread guiding eye 18 is so tapered at its rear portion that a bendable resilient zone 30 arises with the shape of a leaf spring. The leaf spring-like part 30 is clamped at its end remote from the thread guiding eye in a clamping block 35 and is fixedly held by means of this clamping block on the frame of the ring spinning machine on a longitudinal bar 33 of the ring spinning machine. An extension sensitive sensor element 32, which preferably consists of a PVDF piezofoil, is attached to the flat right hand side 34 of the bendable resilient zone of the leaf spring. This foil transmits an extension dependent electrical signal to the subsequent electronic circuit (FIG. 5*a*) via the connection cable 36. The thread 12 runs essentially in a straight line from the delivery roller pair 14, 16 to the thread guide 18 and is deflected at the thread guide as a result of the balloon which forms. The rotational movement of the ring traveller leads to the thread executing a circular movement within the thread guide whereby the forces which are exerted on the thread guide alternately operate to the left and right hand side of the latter. In this way the leaf spring 30 is likewise deflected to the left and then to the right (L and R in FIG. 1*b*), so that the piezofoil likewise executes an oscillating movement and generates an oscillating potential. This alternating movement is important for the manner of operation of the sensor.

Although in the embodiment of FIGS. 1*a*, 1*b* and 2 the piezofoil is arranged in a plane which contains the thread running direction upstream of the thread guide the piezofoil or the leaf spring could also, for example, be arranged displaced sideways relative to the thread guide. This arrangement would also lead to the desired lateral deflection of the leaf spring to both sides.

Figure 7A:
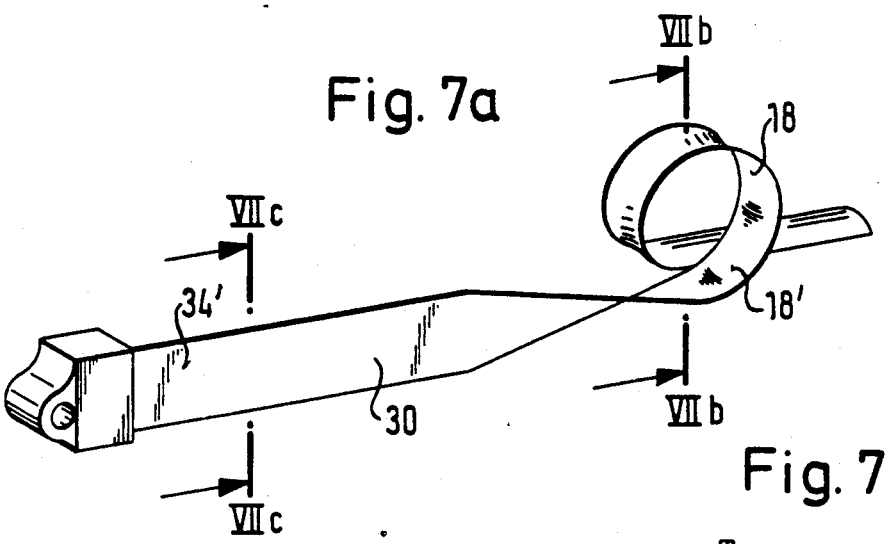
FIG. 7*a* is a schematic illustration of a special embodiment of a thread guiding eye which is particularly suited for the present invention, with the thread guiding eye being built in accordance with FIGS. 1*a* and 1*b*.
Figure 7B:
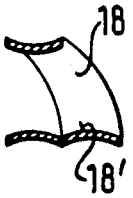
FIG. 7*b* is a cross-section on the line vii*b*—vii*b* of FIG. 7*a*.
Figure 7C:
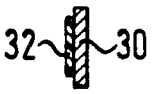
FIG. 7*c* a cross-section on the line vii*c*—vii*c* of FIG. 7*a*.

The possibility also exists of forming the thread guiding eye in one piece of shaped sheet metal as shown in FIGS. 7*a*, 7*b*, and 7*c*. The guiding eye formed of spring is so shaped that it, at least substantially, retains the original straight or rectangular cross-section (FIG. 7*a*) of the strip of sheet metal in the leaf spring part 32. At the transition into the actual eye 18 this cross-section changes into an arched cross-section (FIG. 7*b*), so that the narrowest aperture of the eye is formed by the curved central region 18' of the strip, whereas the edge regions are removed further from the center of the eye. Through this construction, which can be realized at favorable cost, the thread is always guided by the curved region 18' of the strip. Fretting of the thread at the edges of the strip does not arise. The sheet of strip metal can be broader in the leaf spring part than in the eye part, as shown at 34'.

Figure 3A:
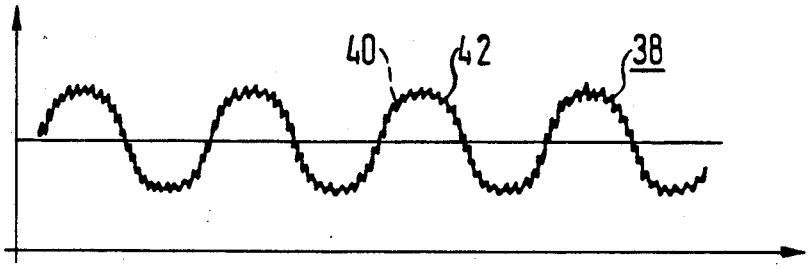
FIG. 3*a* is a graphic illustration of the time dependence of the deflection of the thread guiding eye with high thread tension.
Figure 3B:
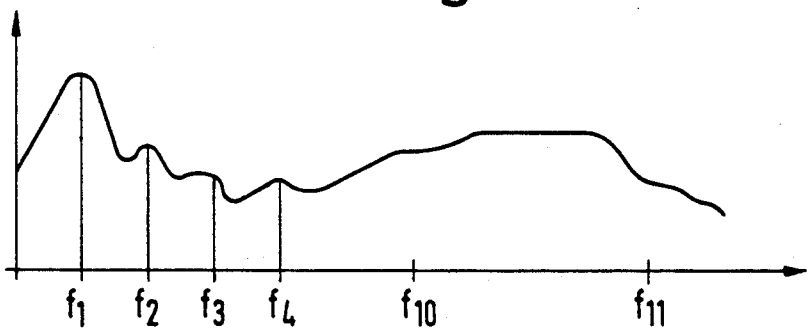
FIG. 3*b* is a spectral illustration of the deflection with a high thread tension.

FIG. 3*a* first shows the time plot 38 for the sideways deflection of the thread guiding eye with a high thread tension, and indeed for an embodiment in accordance with FIGS. 1*a* and 1*b*. One can see that the curve 38 of FIG. 3*a* essentially represents a kind of sine wave 40 with a superimposed high frequency oscillation of a complex nature. The sinusoidal oscillation corresponds to the speed of rotation of the ring traveller 22 and the superimposed oscillations contain information on all other vibrations to which the thread guiding eye is exposed. If one effects a spectral analysis of the sensor signal in accordance with FIG. 3*a* then one obtains a result as shown in FIG. 3*b*. Here one can readily see the speed of rotation f1 of the ring traveller as a basic oscillation in the time plot of the deflection. Harmonic oscillations f2, f3, f4 to f9 and also the so-called thread noise which extends from F10 to f11 are associated with the basic oscillation. The thread noise is produced, on the one hand, by the fibrous surface of the thread and, on the other hand, by the continuously fluctuating cross-section of the thread (thick locations or thin locations).

Figure 4A:
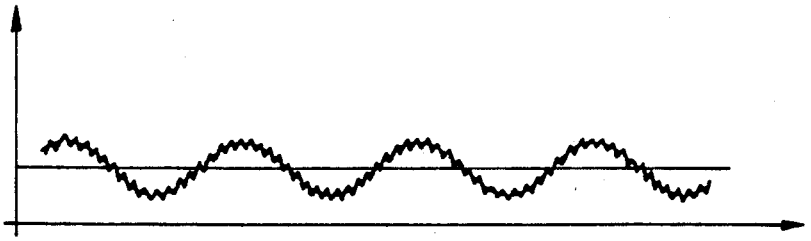
FIG. 4*a* is a graphic illustration of the time dependence of the deflection of the thread guiding eye with a weak thread tension.

Both the level (amplitude) of the speed of rotation f1 and also the level of its harmonics f2 to f9 are a function of the thread tension. This is made clear by a comparison between FIGS. 3*a* and 3*b*, on the one hand, and FIGS. 4*a* and 4*b*, on the other hand. (FIGS. 4*a* and 4*b* relating to a relatively lower thread tension).

Figure 4B:
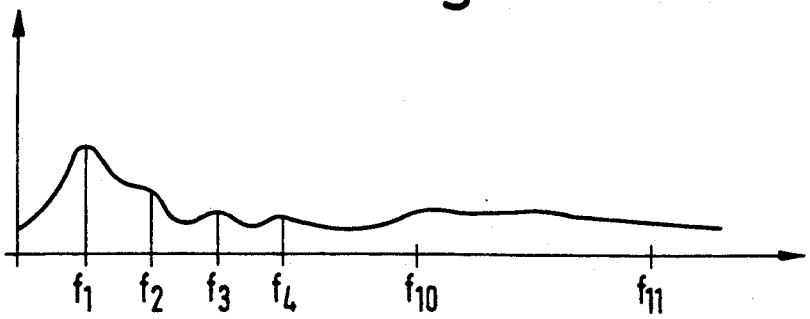
FIG. 4*b* is a spectral illustration of the deflection of the thread guiding eye at weak thread tension.

From FIG. 4*b* one can see that the spectral composition of the signal is very similar to the spectral composition of FIG. 3*b* but that the amplitudes are smaller.

Thus, an evaluation of the sensor signal is possible in both frequency ranges. The evaluation can take place in such a way that the level of the thread tension is detected as a value or in such a way that only a level comparison is made with a reference level. This reference level can depend on machine parameters such as the speed of rotation of the spindle, state of servicing etc. The comparison with a reference level can be used to reduce the thread tension information to a pure thread running or thread breakage information which considerably reduces the complexity required for the transmission of the data and for evaluating the data. It is thus possible to lay out a ring spinning machine in such a way that only a thread breakage signal is generated at all spinning positions but that the thread tension is also measured at some spinning positions. The actual sensor is the same for all spinning positions, there is only a difference in the evaluation of the sensor signal.

The extremely broad band sensitivity of the thread tension sensor of the invention, which extends in accordance with investigations from less than 1 Hz to more than 1 MHz has the consequence that not only the thread tension enters into the sensor signal but also machine vibrations which mainly arise from the region of the speed of rotation of the spindle or ring traveller, but also from high frequency components in the range of the thread noise. If the thread runs through the thread guiding eye then these machine vibrations are not disturbing because they are too weak. In the case of a thread break these vibration signals however arise and simulate a very weak thread tension signal.

Accordingly, a reference sensor is mounted on the machine which operates under precisely the same conditions as the thread tension signal, i.e. is mounted on a thread guide, however the thread guide does not actually guide a thread. The signal of this reference sensor is processed in similar manner to the signals of the thread guiding sensors. The upper reference level is now obtained from the signal of the reference sensor. The reference sensor delivers the reference level for one or more thread breakage sensors. Thus local circumstances which determine the noise level are taken into account. One reference sensor is preferably used for groups with 20 to 60 active sensors.

Figure 5A:
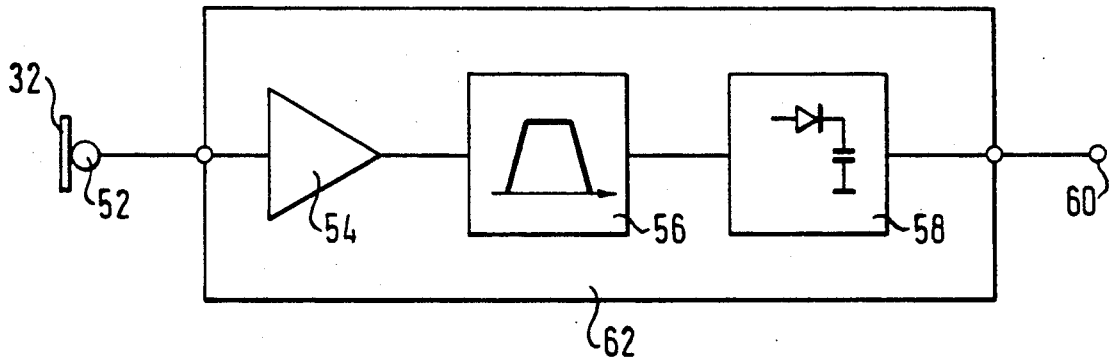
FIGS. 5*a*, 5*b* and 5*c* graphically illustrate various electronic sensor signal processing possibilities.
Figure 5B:
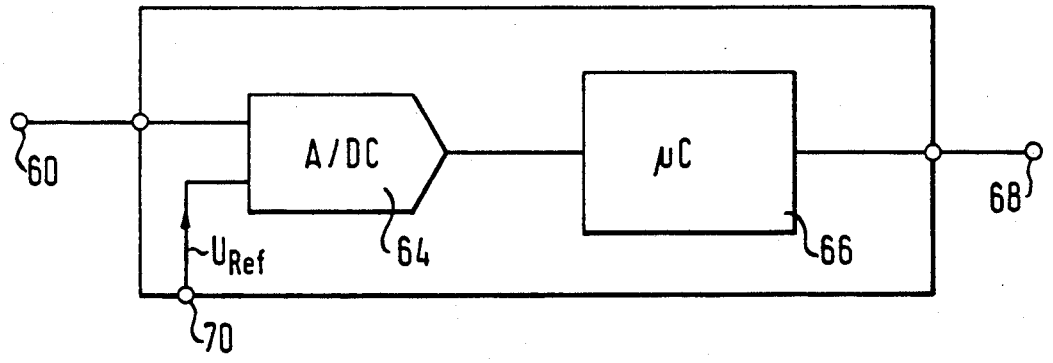
Figure 5C:
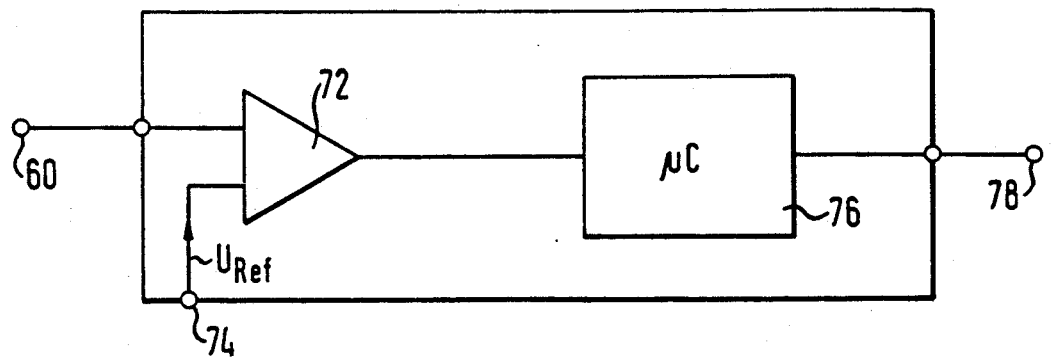

Possible embodiments of the electronic signal processing circuitry are shown in FIGS. 5*a* to 5*c*.

In accordance with FIG. 5*a* the signal of the sensor present at the terminal 52 is amplified in one or more amplifiers 54, is freed from undesired signal components by the filter 56 and is subsequently passed to a rectifier-/integrator 58. The filter 56 can be a so-called adjustably tunable filter which includes a control which locks it to a center frequency corresponding to the speed of rotation of the ring traveller or a harmonic of this value. This "center" frequency can also be asymmetrically disposed in the frequency transmission range of the filter. A particularly preferred filter of this kind will be described later in connection with FIG. 8.

The output signal of the rectifier/integrator 58 which is present at the terminal 60 is then passed to the circuit of FIG. 5*b* as an input signal. The circuit of FIG. 5*a* is characterized as a whole with the reference numeral 62.

In FIG. 5*b* the signal present at the terminal 60 is converted by means of an analog/digital converter 64 to a digital signal which is analyzed by a subsequent microcontroller 66 in order to obtain the thread tension. The terminal 70 makes it possible to apply a reference potential to the analog/digital converter, with this reference potential being obtained from the above mentioned reference sensor and being paired for the purpose of comparison with the signal present at the terminal 60 by a circuit corresponding to the circuit 62. The thread tension signal generated by the microcontroller is present at the terminal 68 and can be shown in the most diverse manners: the thread tension signal can for example be shown on a screen as part of a screen display. It can however also be passed to the machine controlling the speed of rotation of the spindle drive.

FIG. 5*c* shows an alternative embodiment of the evaluation of the signal present at the terminal 60 by a comparator 72 which compares it in analog form with a reference potential URef which is present at the terminal 74 and, as mentioned above, is obtained from the reference sensor via a circuit corresponding to the circuit 62. The output signal of the comparator 72 is then processed further by a microcontroller 76 into a thread tension signal which can be tapped off at the terminal 78. The thread tension signal can be indicated or evaluated in accordance with the thread tension signal present at the terminal 68. In the embodiment of FIG. 5*c* the analog/digital conversion takes place in the microcontroller 76.

In both FIG. 5*b* as well as in FIG. 5*c* one can, instead of applying a real time reference voltage to the reference sensor, use a predetermined reference voltage URef which is either constant or the level of which can be varied in dependence on the machine operating conditions.

Figure 6:
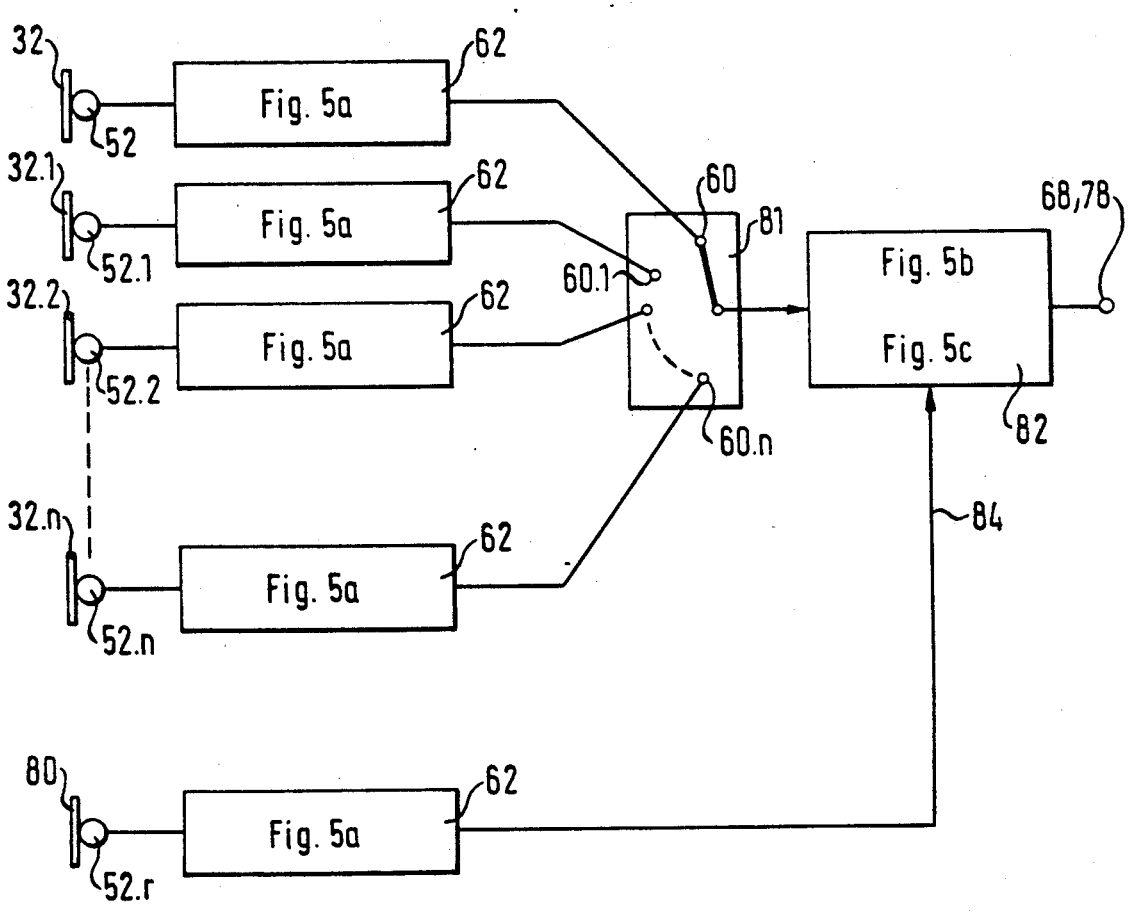
FIG. 6 is a further layout of a thread tension sensor in accordance with the invention.

FIG. 6 shows an alternative evaluation which can in particular be used when a reference sensor 80, as explained above, is mounted on the machine, i.e. when a reference sensor 80 is mounted on a thread guide which does not actually guide a thread.

FIG. 6 shows first of all a series of input terminals 52, 52.1, 52.2 to 52.n which each guide the signal of a thread guiding sensor 32. Each terminal 52 to 52.n leads to a respective circuit 62 in accordance with FIG. 5*a* and the output terminals 60, 60.1 to 60.n of these circuits 62 are applied to an electronic change-over switch 81 which is able to pass the signals on successively or in a predetermined sequence, or in a selected sequence to a further circuit 82, this further circuit 82 can either be formed in accordance with FIG. 5*b* or in accordance with FIG. 5*c*. The terminal 52.r carries the voltage from the reference sensor 80, which has likewise been amplified, filtered and integrated by means of a circuit 62 in accordance with FIG. 5*a*. As the arrow 84 shows, the output signal of the circuit 82 associated with the reference sensor 80 forms the reference potential for the further processing circuit of FIG. 5*b* or FIG. 5*c*.

In other words, the level of the signal from the reference sensor 80 is compared with the level of the signals from the thread guiding sensors 32, 32.1, 32.2 to 32.n. The difference is then further processed as a pure thread tension signal, for example in accordance with FIG. 5*b* or 5*c*. The change-over switch 81 is as a rule not formed as a mechanical switch but rather as an electronic circuit, for example in accordance with a multiplex process. An arrangement in accordance with FIG. 6 has the advantage that only one expensive evaluation circuit is necessary to further process the signals of a plurality of thread breakage sensors into thread tension signals.

In a ring spinning machine with a plurality of spinning positions, for example 1000 or 1200 spinning positions a piezofoil sensor is provided at each thread guide so that a thread break signal can be generated from each of the total number of spinning positions that is present. Moreover, the cabling is so effected that at certain spinning positions, for example every 20th or 50th spinning position the possibility exists of measuring the respective thread tension. On the machine one or two thread guides are en provide at each side which do not guide any thread, but which are formed in precisely the same manner as the other thread guides and are likewise equipped with piezofoil sensors in order to generate the above mentioned reference signals.

A particularly preferred embodiment of an adjustable tuned filter is shown in FIG. 8. This is a block circuit diagram which shows the use of a filter in a switched capacitor embodiment, this filter preferably being present in the form of a chip, namely the chip MF10 from the company National Semiconductors.

As the transmission range of the filter is changed in accordance with the particular speed of rotation of the ring traveller it is necessary to generate a frequency signal which corresponds to the speed of rotation of the ring traveller. It is known that the speed of rotation of the ring traveller is only fractionally lower than the speed of rotation of the spindles of the ring spinning machine. In a ring spinning machine the spindle speed can be relatively easily determined so that one uses the speed of spindle rotation as a guide parameter for the filter in place of the speed of rotation of the ring traveller. The generation of this frequency signal is shown in FIG. 8. The spindles are namely driven by a main motor 100 via a so-called king shaft 102 and belts (not shown) which each drive four spindles. The precise layout of this transmission is well known in the prior art, for example from the Rieter ring spinning machines G5/1.

In order to generate a signal proportional to the speed of rotation of the spindles a tachogenerator 104 is mounted on the main shaft of the drive motor. This tachogenerator consists essentially of a gear wheel 106 and an initiator or sensor 108 which counts the gaps present in the toothed wheel 110 and generates a signal dependent on the speed of rotation of the main motor, this signal being designated "f-sensor" in the drawing. The precise frequency of this signal depends on the number of teeth of the gear wheel and of the speed of rotation of the main motor.

Since a speed conversion takes place between the main motor and the spindles of the ring spinning machine, as a result of the transmissions which are inserted therebetween, it is necessary to multiply the frequency signal by a factor to obtain the actual speed of rotation of the spindles. However the frequency must even then be further increased since one requires a clock frequency for the control of the filter 56 which is admittedly proportional to the speed of rotation of the spindle and of the ring traveller but which is higher frequency-wise by a factor of about 100. For a speed of spindle rotation of 12000 rpm, which corresponds to 200 Hz one thus requires a clock frequency of 20 kHz. The circuit indicated in the drawing as a multiplier 112 thus receives the frequency signal of the sensor at its input and delivers the desired higher clock frequency "f-clock" at its output.

The factor with which the input signal is multiplied in order to generate the clock frequency signal is calculated in accordance with the equation:

$$\text{factor} = 1000 \times n \,/\, \text{number of teeth},$$

where n is the transmission ratio for the speed of rotation of the spindles to the speed of rotation of the main drive.

This clock frequency is then applied to a two-phase clock generator 114 which forms part of the switched capacitor filter 56. Two signals which are displaced by the phases $\tau 1$ and $\tau 2$ are generated with this two-phase clock generator and serve via lines indicated as arrows to actuate two switches 116, 118. These switches serve via lines indicated as arrows to actuate two switches 116, 118. These switches serve to temporarily connect a capacitor with the negative terminal of an operational amplifier 120 which is provided with a further capacitor 122. The frequency with which the switches are alternatingly opened and closed (so that one is open when the other is closed and vice versa) determines the effective impedance of the capacity at the input of the operational amplifier which in turn defines the center frequency of the bandpass filter.

The amplified sensor signal coming from the amplifier 54 is thus applied to the input of the filter and the filter signal at the output of the filter 56 is subsequently passed to the rectifier/integrator 58 in accordance with the circuit of FIG. 5*a*. The described way of measuring the thread tension can be carried out at all ring traveller frequencies which lie clearly above the basic oscillating frequency of the thread guide, i.e. the natural oscillating frequency of the thread guiding eye with its mounting system. In the normal case this basic oscillating frequency is around 10 to 20 Hz and the designation "clearly above" points to frequencies which are a factor of 4 to 10 or more higher. Thus the thread tension measuring process of the present invention can be used with ring traveller speeds of rotation above about 100 Hz, i.e. ca. 6000 rpm. As such speeds of rotation lie beneath the range of speeds of rotation of the spindles of the ring spinning machine which are of interest this lower limit for the evaluation of the thread tension does not represent any restriction in practice.

An advantage of using a filter in the switched capacitor embodiment lies in the fact that the bandwidth of the transmission range of the filter is changed in proportion to the center frequency in such a way that the quality factor Q of the filter remains at least substantially constant, which is favorable for the signal processing.

It is important when using the sensor of the present invention that the sensor is attached to the mounting of the thread guide in a plane such that the rotary movement of the thread within the thread guide leads to a deflection of the mounting to both sides and thus to a corresponding extension and compression of the piezofoil. Expressed differently, the sensor should be so arranged in the form of the piezofoil in a plane containing the thread running direction or a plane parallel to the latter that the mounting of the thread guide executes elastic movements to both sides, related to the thread running direction. The thread running direction signifies in the ring spinning machine, for example the direction of running of the thread between the delivery cylinder pair and the thread guide or the mean direction of running of the thread within the thread balloon which corresponds with the geometrical axis of the thread balloon.

Finally, FIG. 9 shows a thread tension sensor which operates differently from the previously described thread tension sensor. In FIG. 9 it is schematically shown that the thread guiding eye 18 is mounted via a first force measuring cell 90 to a web 92 of a holder 94 for a thread guide. Stated more precisely the thread guiding eye is attached to the one end face of the force measuring cell 90 and the other end face of the force measuring cell is attached to the web 92. A further force measuring cell 96 is located on the other side of the web 92 and is likewise secured at its one end face to the web 92, while a compensation mass 98 with the mass m2 is attached to the end face of the force measuring cell 96 which is remote from the web. The force measuring cell 96 is thus aligned with the force measuring cell 90 but arranged on the other side of the web 92. The thread guiding eye 18 has a mass m1.

As a result of the thread movement oscillations of the thread guiding eye are generated and these lead to oscillations of the web which are designated in the drawing by a. Oscillations of the holder for the thread guide 94 lead to oscillations of the web. These oscillations lead, as a result of the fluctuating accelerations of the masses m1 and m2 to fluctuations of the forces at the force measuring cells 90 and 96 so that these deliver output signals U1 and U2 with corresponding fluctuations.

One can mathematically portray these voltages U1 and U2 as follows:

$$U1 = C1\,(A \,.\, m1 + F)$$

$$U2 = C2\,(A \,.\, m2).$$

Here A is the acceleration of the web 92 and F the desired thread tension. C1 and C2 are constants.

If one subtracts these two signals then one arrives at $$U = U1 - U2 = A\,(C1 \,.\, m1 - C2 \,.\, m2) + C1 \,.\, F.$$

When $C1 \,.\, m1 - C2 \,.\, m2 = 0$ (balance) then one can write $$U \approx C1 \,.\, F.$$

In other words F is approximately equal to U divided by C1. Since C1 . m1 is a constant and $\Delta U$ can be directly measured one has obtained, in accordance with the invention, a signal for the thread tension.

A thread tension sensor of the last described kind is thus characterized in that a thread guiding eye is connected to the one side of a web of a holder for the thread guide via a force measuring cell; in that a further force measuring cell is mounted on the other side of the web to the latter and is aligned with the first force measuring cell, with a mass which compensates compensates for the mass of the thread guiding eye being attached to the second force measuring cell; and in that the output signals of the two force measuring cells are supplied to a difference forming circuit, the output signal of which is proportional to the thread tension.

At this stage it should be made clear that so-called piezofoils can be obtained from different manufacturers, for example form the US company Pennwalt Corporation under the name "Kynar" (registered trademark). PVDF is an abbreviation for polyvinylidene fluoride, which belongs to the class of piezoelectric polymers. Piezofoils of this kind which are suitable for this application, preferably have a broad-banded frequency response with a quality factor Q which tend to zero.

Figure 10A:
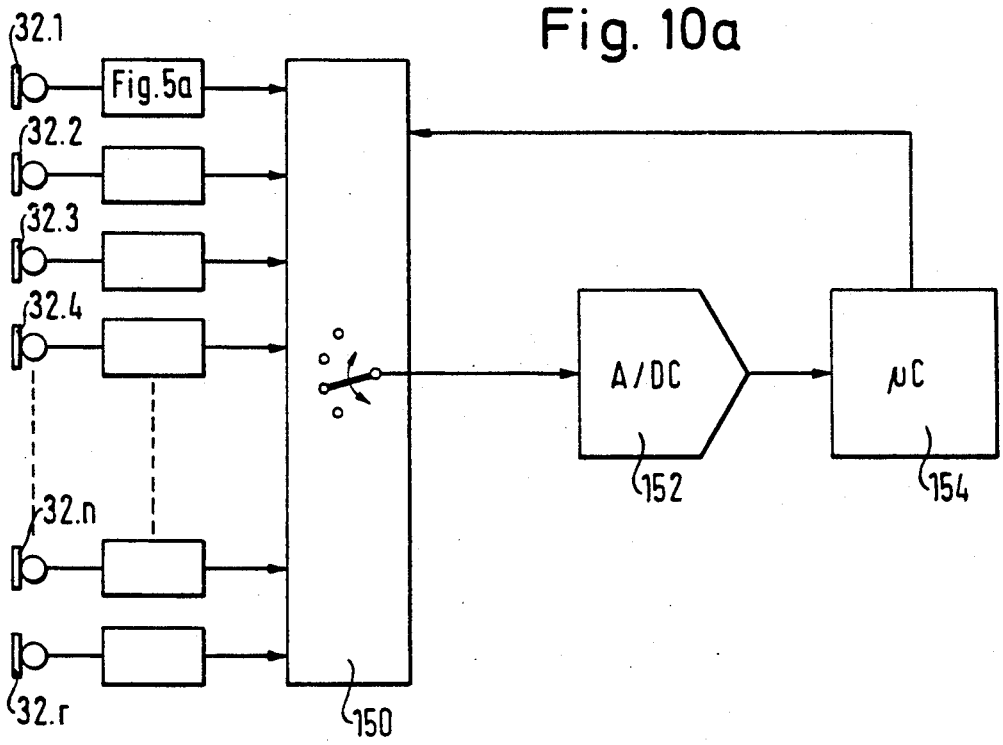
FIG. 10*a* and FIG. 10*b*, show two ways of processing the signals received from a group of thread tension sensors to obtain thread tension signals.

FIG. 10*a* shows a specially preferred embodiment for the processing of the signals from a group of sensor 52.1 to 52.n and from a reference sensor 52.r using a 16 port multiplexer. For this reason n will typically have a maximum value of 15 and one further port will be used for the reference sensor. Thus in practice a dummy thread guide will be provided for each group of 15 true thread guides, i.e. thread guides which actually guide a thread to a spinning position and the circuit of FIG. 10*a* will be duplicated for each group of 15 true thread guides.

The sensor signals, i.e. the signals coming from the sensors 52.1 to 52.n are amplified, filtered and rectified by a circuit corresponding to FIG. 5*a* before being passed to the common multiplexer 150. The individual channels, i.e. the signals from the individual sensors 52.1 to 52.n and 52.r are connected to the analog digital converter 152 in turn with the microcontroller 154 specifying the sensor addresses to the multiplexer. The levels of the sensors 52.1 to 52.n are compared from the point of view of their size with the reference level from the reference sensor 52.r, the difference corresponds to the thread tension and can be present either as a comparative value or after appropriate calibration as an absolute value.

In this embodiment the elements of the circuit of FIG. 5*a* are present for each sensor and integrated into the mounting for the sensor. This is however slightly wasteful and a further improvement is shown in FIG. 10*b* where each sensor is provided only with an amplifier and the filter and analog digital converter are placed after the multiplexer.

More specifically, the signals of the sensors 52.1 to 52.n and of the reference sensor 52.r are passed on in amplified form to the multiplexer. The microcontroller 154 provides the multiplexer with the addresses for the sensors which are to be switched in. After the multiplexer the signal is filtered, for example by a circuit in accordance with FIG. 8, and converted into a digital signal by the analog to digital converter 152. This signal is then passed to the microcontroller 154. If the system consisting of the analog to digital converter and the microcontroller does not operate sufficiently quickly then a rectifier 156 is inserted between the filter and the analog to digital converter which has the consequence that it is no longer necessary to convert and evaluate frequencies up to 300 Hz but rather only frequencies of ca. 1 Hz must be measured. With a favorable layout of the circuit the individual amplifier stages in or at the sensors can be replaced by a single amplifier after the multiplexer.

Figure 10B:
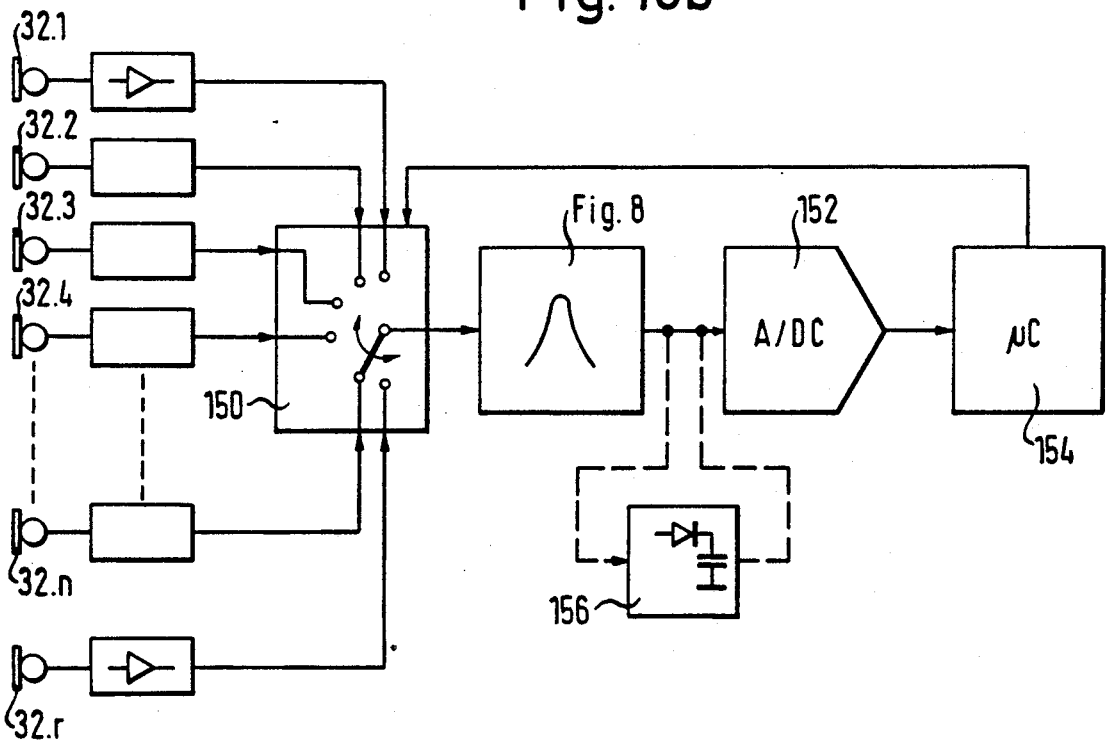

FIGS. 10*a* and 10*b* describe circuit variants which permit the measurement of thread tension at all sensors.

Figure 11:
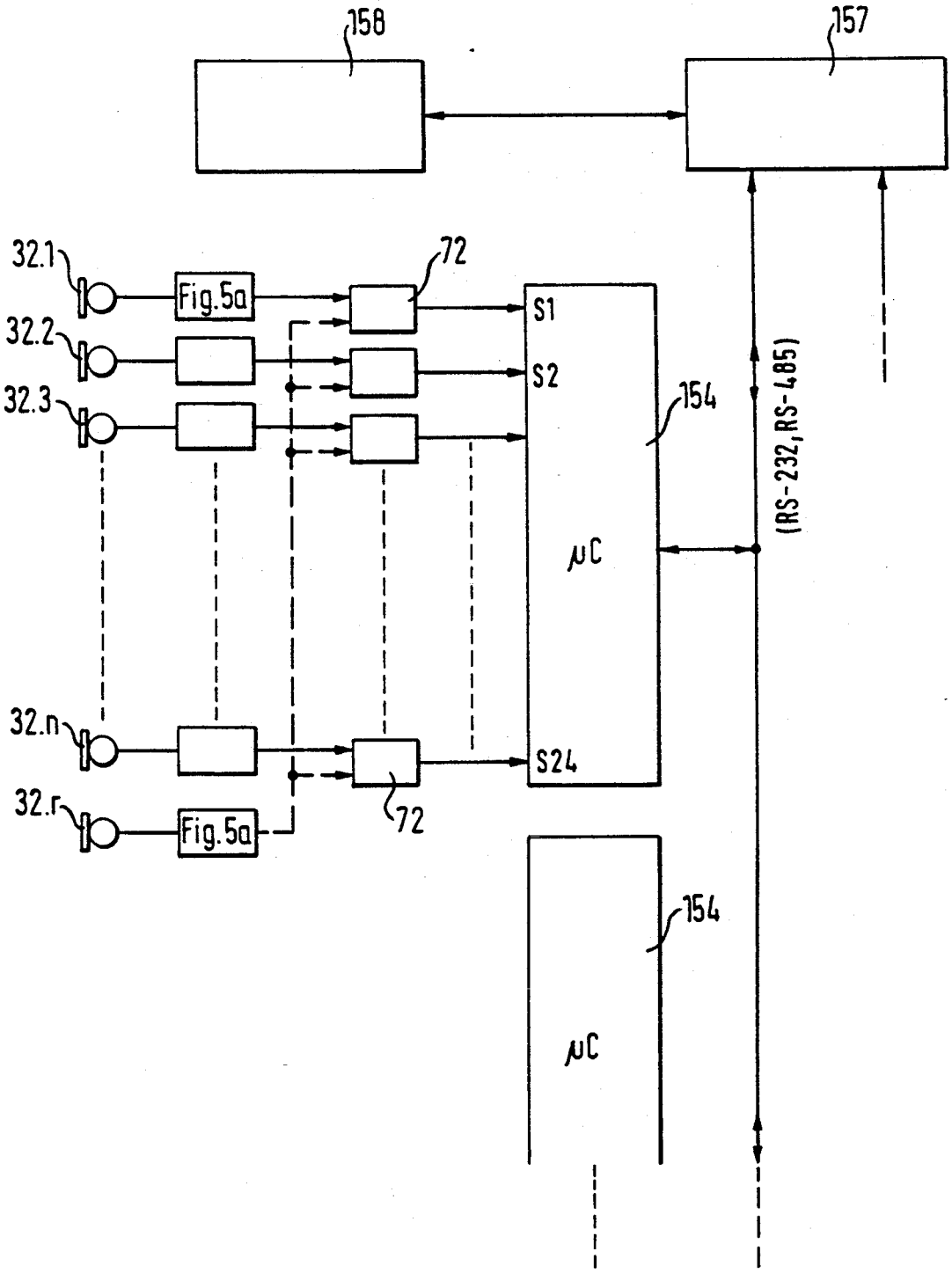
FIG. 11 is a way of processing signals received from a plurality of sensors to obtain pure thread breakage information.

In contrast FIG. 11 is concerned with the determination of whether or not a thread is broken at each of the spinning positions.

Here the sensor signals are processed in parallel. The sensors are again combined into groups 52.1 to 52.n together with a reference sensor 52.r. In this case the total number of sensors of a group can amount to 32.

As can be seen from FIG. 11 the sensor signals are first amplified, filtered and rectified and are then compared in respective comparators equivalent to the comparator 72 of FIG. 5*c* with the reference signal from the reference sensor 52.r. The output of the comparators 72 is in fact a digital signal since the comparator simply takes a decision as to whether the level from an active sensor is higher or lower than the reference level from the reference sensor. All signals are applied in parallel to the port inputs of the microcontroller 154. This microcontroller can for example be an element of the type designated 80C31 from the Intel Company. The advantage of this variant is that a simple low performance (cost favorable microcontroller 154) can be used (for example 80C31 from Intel). A thread tension measurement is not possible here.

It will be seen that the output signals from the individual microcontrollers 154 associated with the individual sensor groups all communicate with a serial data bus which can for example be RS232 or an RS485.

By way of example about 50 microcontrollers are connected with this series data bus with a master controller 156 which can in fact again be formed by a component (chip) 80C31 from Intel. This master controller is concerned with the evaluation of the thread information and provides the machine control or a process control 158 with the data in a compressed form, for example statistically evaluated.

With machines with over 1000 spindles it can be advantageous to distribute the microcontrollers 154 on two series data buses, for example one for each side of the machine.

It should also be mentioned that combinations of the circuits of FIGS. 10*a*, 10*b* and 11 are possible and that it is also possible to supply the sensor signals as yes/no information (thread break information) in parallel or by a multiplexer to the microcontroller while one sensor per microcontroller group is selected to provide a thread tension measurement by way of an A/D converter (which can be an integrated component of the microcontroller).

What is claimed is:

1. A method of measuring the tension in a running thread on a textile machine having means for winding said running thread, a thread guide for guiding said thread and a sensor connected to said thread guide for sensing oscillations of said thread guide, said sensor comprising a piezofoil disposed in a plane which is parallel to a plane in which said running thread is situated, comprising the steps of:

(a) supplying a running thread to said textile machine;

(b) winding said running thread onto a cop;

(c) passing said running thread through said thread guide;

(d) sensing oscillations of said thread guide and producing a signal corresponding to said oscillations and the tension in said running thread; and (e) filtering said signal to obtain elements of said signal corresponding to a basic frequency of operation of said winding means or an harmonic thereof and obtaining from said filtered out frequency a signal corresponding to said tension in said running thread.

2. A method as set forth in claim 1, further including the step of amplifying said signal.

3. A method as set forth in claim 1, further including the step of converting said signal to a digital form.

4. A method as set forth in claim 1, further including the step of comparing said signal to a reference signal.

5. A method as set forth in claim 4, further including the step of adjusting the level of said reference signal in accordance with an operating state of said textile machine.

6. A method as set forth in claim 4, further including the step of generating said reference signal with a reference sensor disposed on a thread guide which has no running thread passing through it.

7. A thread tension sensor for sensing tension in a running thread on a textile machine which has a winding element that is operable at least one basic frequency for winding said running thread onto a package, comprising:

(a) a thread guide for guiding said running thread on said textile machine;

(b) mounting means for supporting said thread guide on said textile machine to permit said thread guide to oscillate;

(c) a piezofoil sensing element disposed on said thread guide in a plane which is parallel to a plane through which said running thread passes for generating an electrical signal corresponding to oscillations of said thread guide;

(d) a tune filter for filtering said electrical signal to produce and transmit an output signal;

(e) means for tuning said filter in accordance with the prevailing basic frequency of said winding element or an harmonic frequency of said prevailing frequency; and (f) means for measuring the level of said output signal corresponding to the level of tension in said running thread.

8. A thread tension sensor as set forth in claim 7 wherein said tuned filter is a filter in switch capacitor form.

9. A tread tension sensor as set forth in claim 7, wherein said tuned filter has a frequency band width in the region of between 5 and 15 percent of a selected harmonic frequency of said winding element.

10. A thread tension sensor as set forth in claim 9, wherein a selected transmission range of said filter lies in the upper part of its band width.

11. A thread tension sensor as set forth in claim 7, wherein said thread guide is in the form of a pigtail.

12. A tread tension sensor as set forth in claim 7, wherein said mounting means is formed in one piece with the thread guide in the shape of a leaf spring and said sensing element is attached to said spring.

13. A tread tension sensor as set forth in claim 7, wherein a reference sensor is disposed on said textile machine in a position where it is subjected to vibrations of said machine but it is not subjected to vibrations induced by a running thread.

14. A tread tension sensor as set forth in claim 13 further comprising means for comparing said electrical signal to a reference signal to produce said output signal.

15. A tread tension sensor as set forth in claim 14, including means for using said reference signal as a threshold value for generating a binary thread break signal.

16. A tread tension sensor as set forth in claim 13, including means in said reference sensor for excluding environmental signals above a predetermined level.

17. A tread tension sensor as set forth in claim 7, wherein said thread tension sensor is enclosed in a housing attached to said textile machine and acoustic insulation is disposed between said housing and said textile machine.

18. A tread tension sensor as set forth in claim 7, including means for amplifying said electrical signal before transmitting said signal to said tuned filter.

19. A tread tension sensor as set forth in claim 18, further comprising a microcontroller for evaluating said electrical signal.

* * * * *